United States Patent [19]

Helmer

[11] Patent Number: 4,807,449

[45] Date of Patent: Feb. 28, 1989

[54] LATENT HEAT ECONOMIZING DEVICE FOR REFRIGERATION SYSTEMS

[76] Inventor: James R. Helmer, 205 Quincy St., Kingsford, Mich. 49801

[21] Appl. No.: 928,830

[22] Filed: Nov. 10, 1986

[51] Int. Cl.[4] ..... F25B 43/00

[52] U.S. Cl. ..... 62/503; 62/509; 62/512; 62/513

[58] Field of Search ..... 62/509, 512, 513, 510

[56] References Cited

U.S. PATENT DOCUMENTS

| | | | |
|---|---|---|---|
| 2,819,592 | 1/1958 | Smith | 62/117 |
| 3,084,523 | 4/1963 | Bottum et al. | 62/296 |
| 3,310,103 | 3/1967 | Osborne | 62/512 |
| 3,473,348 | 10/1969 | Bottum | 62/513 |
| 3,481,151 | 12/1969 | Seeley | 62/512 |
| 3,553,974 | 1/1971 | Osborne | 62/512 |
| 3,952,533 | 4/1976 | Johnston et al. | 62/513 |
| 4,141,708 | 2/1979 | Lavigne, Jr. et al. | 62/510 |
| 4,142,381 | 3/1979 | Lavigne, Jr. et al. | 62/510 |
| 4,207,749 | 6/1980 | Lavigne, Jr. et al. | 62/510 |
| 4,537,045 | 8/1985 | Mayer | 62/503 |
| 4,683,726 | 4/1987 | Barron | 62/513 |
| 4,694,662 | 9/1987 | Adams | 62/513 |

OTHER PUBLICATIONS

Althouse, Turnquist and Bracciano, *Modern Refrigeration and Air Conditioning* (1968 by Goodheart-Willcox Co., Inc.) p. 505.

*Primary Examiner*—Ronald C. Capossela

*Attorney, Agent, or Firm*—Kanz, Scherback & Timmons

[57] ABSTRACT

A latent heat economizing device having a shell forming a chamber, a saturated refrigerant inlet, a liquid refrigerant outlet, a dual air pass and a suction gas pass is provided for installation in the liquid refrigerant line of a refrigeration system prior to an existing liquid subcooler upstream from a metering device in the direction of flow. The inlet includes means for distribution of saturated refrigerant evenly over the internal surface area of the chamber to effect heat transfer and removal of the latent heat of condensation from the vapor and sub-cooling of refrigerant liquid. A liquid level is maintained within the shell to effect heat transfer from the liquid to the suction gas pass. The outlet for the liquid is connected to the lowest part of the shell to insure that no vapor is passed through the outlet to the metering device.

17 Claims, 2 Drawing Sheets

LATENT HEAT ECONOMIZING DEVICE FOR REFRIGERATION SYSTEMS

SUMMARY OF THE INVENTION

The present invention relates to closed circuit refrigeration systems having an evaporator, a compressor, a condenser and a metering device, such as an expansion valve. More particularly, it relates to a device for use in such a system which condenses vapors and pre-cools refrigerant coming from the condenser prior to entering the metering device.

Refrigeration systems are subject to a number of environmental factors which affect system efficiency. For example, system inefficiency may result from the formation of vapor in the liquid line between the condenser and the metering device. In many systems, the distance between the condenser and the metering device is substantialy enough to allow a pressure drop which causes this formation of vapor. Metering devices are rated in their capacity by assuming that the refrigerant coming from the condenser and entering the metering device is 100% liquid. Any vapor present prior to the metering device not only reduces the capacity of the metering device, but also reduces the effective latent heat available for evaporation in the evaporator. This means that the compressor must pump a quantity of refrigerant gas, which gas performs no useful working function. Additionally, under extremely high ambient conditions some refrigerants have a critical temperature at which point the given refrigerant will not liquify, no matter how much pressure is imposed upon it. During these conditions, refrigeration effect is reduced in a direct relationship to the degree ambient temperature approaches a maximum, which is generally accepted to be 110 degrees Fahrenheit.

Various approaches have been utilized to overcome the inefficiencies caused by vapor formation. The most common approach involves increasing the refrigerant charge to effect an increase in pressure in the liquid line to the point where no vapor will form under full load conditions. However, this results in a greater amount of energy consumption by the compressor. It has also been the practice to employ a system such as that disclosed in U.S. Pat. No. 4,259,848. In that system, vapor formed in the liquid line is withdrawn from a receiver 24 by a dual suction compressor 16, and a refrigerant approaching the expansion valve 26 is pre-cooled in a heat exchanger 34, by the withdrawal of vapor from the high pressure portion of the refrigerant circuit. While this system works under some conditions, it cannot be used on systems which use a hot or "Koolgas" defrost. Additionally, the compressor is required to pump gas which performs no working function.

It is, therefore, a principal object of this invention to provide a device which effectively removes the latent heat of condensation from the vapor and pre-cools the liquid refrigerant prior to the metering device while increasing the effective latent heat for evaporation available to the evaporator without recirculating refrigerant through the compressor which performs no actual refrigeration. It is still another object of this invention to provide such a device which also remains uncomplicated in design, construction and installation.

The present invention has obtained these objects. It provides a device for condensing vaporized refrigerant and sub-cooling liquid refrigerant prior to entering the metering device, such as an expansion valve in a closed circuit refrigeration system. The latent heat economizing device of the present invention provides for a shell forming a chamber having a saturated refrigerant inlet, a liquid refrigerant outlet, a dual air pass, and a suction gas inlet and outlet pass-through, which is installed in the liquid refrigerant line prior to an existing liquid sub-cooler upstream from the metering device in the direction of flow. The saturated refrigerant inlet includes means for distributing the saturated refrigerant evenly over the internal surface area of the shell to effect heat transfer and removal of the latent heat of condensation from the vapor and sub-cooling of refrigerant liquid. A liquid level is maintained within the shell to effect heat transfer from the liquid to the suction gas pass. The outlet for the liquid is connected to the lowest part of the shell to insure that no vapor is passed through the outlet to the metering device. In this configuration, the condensing unit removes the majority of the sensible heat and latent heat from the refrigerant. The latent heat economizing device removes the latent heat from the liquid vapor in the liquid line which accomplishes a fine tuning effect on the system, thereby increasing condensing unit capacity by decreasing necessary operating head pressure and amperage of the compressor. As the compressor capacity increases, cooling is accomplished in a more efficient matter. In other words, systems utilizing the present invention can provide the same amount of cooling with the decrease in required running time, thereby conserving energy. The foregoing and other features of the device of the present invention will be apparent from the description which follows.

DETAILED DESCRIPTION

Figure 3:
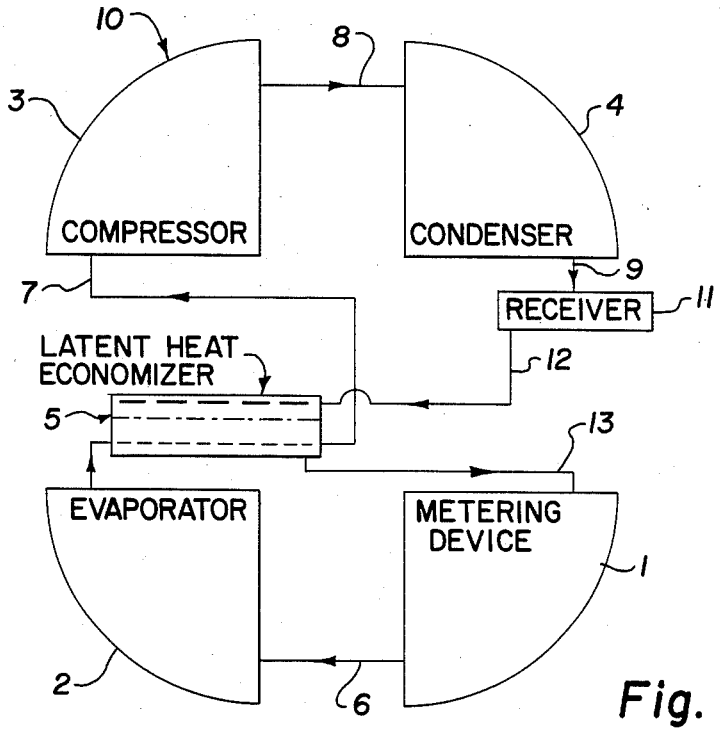
FIG. 3 is a schematic view of a basic four-part refrigeration cycle utilizing the device of the present invention.

Reference is now made more particularly to the drawings and particularly to FIG. 3 which schematically illustrates a conventional closed circuit refrigeration system 10 into which a latent heat economizing device 5 of the present invention is incorporated. The refrigeration system 10 includes a metering device 1, generally a thermal expansion valve. A low pressure liquid line 6 extends from the metering device 1 to the evaporator 2 where the refrigerant is vaporized as it absorbs heat. From the evaporator 2 the vaporized refrigerant passes through a line 7 to the compressor 3. Compressor 3 may be one of three classes of motor driven units, either hermetic, semi-hermetic or belt-driven. From the compressor 3, where the refrigerant is changed from a low pressure superheated vapor to a high pressure superheated vapor, the refrigerant is passed through a line 8 to the condenser 4 where the latent heat of condensation is removed from the refrigerant. From the condenser 4, the refrigerant is in a liquid state at its point of saturation and is passed through a line 9 to a receiver 11, which receiver 11 is normally used for storage of refrigerant when the system 10 is pumped down for service or part replacement and holds a reserve charge. From the receiver 11, the refrigerant passes through a line 12 to the latent heat economizing device 5. Any vapor contained in the refrigerant coming from the line 12 is condensed and the liquid refrigerant is sub-cooled in the device 5 prior to entering the metering device 1 through the line 13 leading to it. The line 7 between the evaporator 2 and the compressor 3 in turn passes through the device 5.

Figure 1:
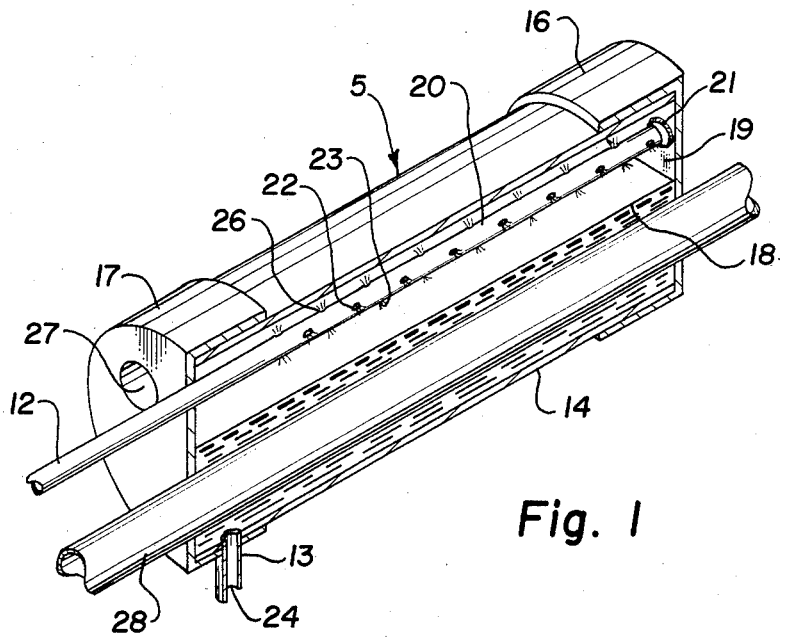
FIG. 1 is a perspective cross-sectional view of a preferred embodiment of the latent heat economizing device of the present invention mounted in the horizontal position.
Figure 2:
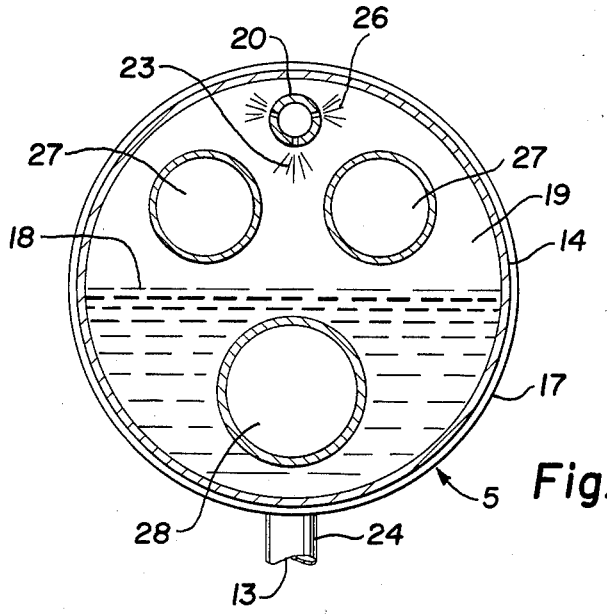
FIG. 2 is another cross-sectional view of the embodiment illustrated in FIG. 1.

Referring particularly to FIGS. 1 and 2, it can be seen that the latent heat economizing device 5 is illustrated in several cross-sectional views. The latent heat economizing device 5 includes a shell 14 having an inlet line 12 coming from the receiver 11 and an outlet line 13 leading to the metering device 1 as shownin FIG. 3. The shell 14 is formed from a cylindrical tube and has end cpas 16, 17. The shell 14 defines a chamber which is partially filled with refrigerant such that there is a liquid level 18 and a vapor space 19 therein.

A portion of the inlet line 12 extends into the shell 14 to form a distributor means 20 which is centered in the vapor space 19. The end of the distributor means 20 includes a cap or plug 21. Alternatively, the end of the distributor means 20 may be crimped to prevent passage of vapor or liquid. A plurality of orifices 22 are formulated along the length of the distributor means 20 to release the liquid refrigerant 23 downward and the vapors 26 into the upper section of the vapor space 19. Air passes 27 are provided which remove the latent heat of condensation from the vapors to 26 in the vapor space 19, thereby liquifying the refrigerant which drops to the liquid space 18 in the lower section of the shell 14. Once in the lower section 18 of the shell 14, the refrigerant 23 comes into direct thermal contact with the suction gas pass 28 where the additional heat is transferred to the cold vapors returning to the compressor 3 through a line 7 coming from the evaporator 2, as shown in FIG. 3. The suction gas pass 28, in sub-cooling the liquid refrigerant prior to the outlet 13, 24 also serves as a heat source to vaporize any liquid which may be contained in gases returning to the compressor 3 which provides an additional degree of protection to the compressor 3 from a phenomenon known as "liquid flood-back" which is harmful to compressors.

The number and size of the distributor means orifices 22 is formulated according to application of tonnage to effect little or no pressure drop, which would cause vapor formation and decrease the desired effect of the latent heat economizing device 5. Because the latent heat economizing device 5 has the ability to condense the vapors received from the liquid line 12, the necessity of increasing the refrigerant charge to effect an increase in head pressure to produce a clear sight glass directly after the receiver 11 is eliminated. In addition, under high ambient conditions, refrigerants sometimes reach a critical point where they will not liquify no matter how much pressure is imposed upon them. The incorporation of the latent heat economizing device 5 into the system 10 reduces the critical temperature effect on the system and in all cases produces an increase in efficiency. In conditions of low temperature applications, the suction gas pass 28 becomes an option to be used as an additional air pass 27 where existing temperatures are sufficient to effect both the condensation and sub-cooling of the refrigerant.

As can be seen from the foregoing, the present invention provides a fixed latent heat economizing device which can be added to substantially any refrigeration system to improve its efficiency. The latent heat economizing device provides for the condensation of any vapor present in the liquid line prior to the metering device, thereby eliminating the necessity to increase head pressure to overcome vapor in the liquid line and thereby reflecting an increase in the volumetric efficiency of the compressor. It is intended that the invention not be limited to the particular embodiment disclosed, but that the invention will include all embodiments falling within the scope of the subjoined claims.

The principles of this invention having been fully explained in connection with the foregoing description, I hereby claim as my invention:

1. For use with a refrigeration system having an evaporator, a compressor, a condenser, a metering device and refrigerant lines therebetween, a refrigeration system component comprising a closed hollow body having walls defining a chamber, a chamber inlet means for receiving liquified and vaporized refrigerant from the condenser, a distribution means connected to said chamber inlet means and extending into said chamber to distribute the liquified and vaporized refrigerant therein, a plurality of conduits extending through said chamber and penetrating sealingly through said hollow body walls, each conduit having an exterior surface and an interior passageway such that the exterior conduit surface will be in contact with the liquified and vaporized refrigerant in said chamber and said conduit interior passageway will be isolated therefrom, one of said conduits will be wholly immersed in the liquid refrigerant in said chamber and adapted to be connected at one end to the refrigerant line leading from the evaporator and at the other end to the refrigerant line leading to the compressor, and a chamber outlet means for flow to the metering device only of liquified refrigerant, 2. The refrigeration system component of claim 1 wherein the conduits are made of thermally conductive material.

3. The refrigeration system component of claim 1 wherein the distribution means comprises a tube having a sealed distal end and a plurality of orifices along its length such that the liquified and vaporized refrigerant passing through said chamber inlet means is distributed within said chamber and over said conduits with the liquified refrigerant being directed downward and the vaporized refrigerant being directed upward.

4. The refrigeration component of claim 3 in which the number and size of said orifices provide little pressure drop as the vaporized refrigerant and liquid refrigerant enter said chamber.

5. The refrigeration component of claim 1 in which at least one said conduits is open-ended for passage of air therethrough.

6. For use with a refrigeration system having an evaporator, a compressor, a condenser, a metering device and refrigerant lines therebetween, a refrigeration system component comprising a primary conduit for the passage of refrigerant from the evaporator to the compressor therethrough, at least one secondary conduit for the passage of air therethrough, a shell about said primary and secondary conduits, a shell inlet means connected to said condenser to receive liquified and vaporized refrigerant therefrom, a shell inlet distribution means extending into said shell to distribute said liquified and vaporized refrigerant therein and over said primary and secondary conduits, and a shell outlet means for connection to said metering device for discharge of liquified refrigerant from said shell thereto.

7. The refrigeration system component of claim 6 wherein the primary and secondary conduits are made of thermally conductive material.

8. The refrigeration system component of claim 6 wherein the shell inlet distribution means comprises a close-ended tube having a plurality of orifices along its length for release of vaporized refrigerant upward and release of liquid refrigerant downward.

9. The refrigeration component of claim 8 in which the number and size of said orifices provide little pressure drop as the vaporized refrigerant and liquid refrigerant enter said shell.

10. The refrigeration system component of claim 6 wherein said shell has a top portion and bottom portion, said distribution means and secondary conduits being situated generally toward the top of said shell, said primary conduit and shell outlet means being situated generally toward the bottom of said shell such that said vaporized refrigerant being distributed in said chamber is in heat-exchanging relationship with said secondary conduits and said liquified refrigerant is in heat-exchanging relationship with said primary conduit.

11. The refrigerant component of claim 6 having at least two secondary conduits.

12. A refrigeration system having an evaporator, a compressor, a condenser, a metering device and refrigerant lines therebetween, and further including a refrigeration system component which comprises a housing connected between said condenser and said metering device, said housing comprising a hollow body having a first and second end, a first end cap closing said first housing end, said first end cap closing said first housing end, said first end cap having an inlet means connected to said condenser to receive liquified and vaporized refrigerant therefrom, an outlet means connected to said compressor for discharge of vaporized refrigerant thereto, and a plurality of air portals, a second end cap closing said second housing end, said second end cap having an inlet means connected to said evaporator to receive vaporized refrigerant thereform and having a plurality of air portals, a primary conduit sealingly engaged with and extending between said first end cap inlet means and said second end cap outlet means to allow for passage of vaporized refrigerant from said evaporator to said compressor, a plurality of secondary conduits, each sealingly engaged with and extending between one of said first end cap air portals and one of said second end cap portals to allow for circulation of air therethrough, a distribution means connected to said first end cap inlet means and extending into said hollow body to distribute said refrigerant therein and over said primary and secondary conduits, and a hollow body outlet means connected to said metering device for discharge of liquified refrigerant thereto.

13. The refrigeration system component of claim 12 wherein the primary and seconary conduits are made of thermally conductive material.

14. The refrigeration system component of claim 12 wherein the distribution means comprises a tube being sealed at a distal end and having a plurality of orifices along its length for release of vaporized refrigerant upward and release of liquid refrigerant downward.

15. The refrigerant component of claim 14 in which the number and size of said orifices provide little pressure drop as the vaporized refrigerant and liquid refrigerant enter said housing.

16. The refrigeration system component of claim 12 wherein said primary conduit comprises an additional secondary conduit.

17. The refrigeration system component of claim 12 wherein said hollow body has a top portion and a bottom portion, said distribution means and secondary conduits being situated generally toward the top of said hollow body, said primary conduit and hollow body outlet means being situated generally toward the bottom of said hollow body such that said vaporized refrigerant being distributed in said hollow body is in heat exchanging relationship with said secondary conduits and said liquified refrigerant is in heat exchanging relationship with said primary conduit.

* * * * *